US009771182B2

(12) United States Patent
Kawano

(10) Patent No.: US 9,771,182 B2
(45) Date of Patent: Sep. 26, 2017

(54) SYSTEM AND METHOD FOR BAG DELIVERY

(75) Inventor: Yasushi Kawano, Yotsukaido (JP)

(73) Assignee: Amazon Technologies, Inc., Reno, NV (US)

( * ) Notice: Subject to any disclaimer, the term of this patent is extended or adjusted under 35 U.S.C. 154(b) by 617 days.

(21) Appl. No.: 14/356,851

(22) PCT Filed: Nov. 8, 2011

(86) PCT No.: PCT/US2011/059809

§ 371 (c)(1),
(2), (4) Date: Aug. 12, 2014

(87) PCT Pub. No.: WO2013/070197

PCT Pub. Date: May 16, 2013

(65) Prior Publication Data

US 2014/0367304 A1 Dec. 18, 2014

(51) Int. Cl.
*B65D 1/34* (2006.01)
*B65D 33/00* (2006.01)
(Continued)

(52) U.S. Cl.
CPC ..... *B65D 33/001* (2013.01); *A47F 9/042* (2013.01); *B65B 55/00* (2013.01); *B65D 5/001* (2013.01); *B65D 5/508* (2013.01)

(58) Field of Classification Search
CPC ..... B65D 5/001; B65D 5/508; B65D 33/001; A47F 9/042
(Continued)

(56) References Cited

U.S. PATENT DOCUMENTS 3,339,721 A * 9/1967 Goldstein ..... B65D 33/02 206/499
3,462,006 A 8/1969 Scott
(Continued)

FOREIGN PATENT DOCUMENTS

CN 1196024 A 10/1998
CN 101151194 A 3/2008
(Continued)

OTHER PUBLICATIONS

Chinese Office Action dated Feb. 5, 2015, for corresponding CN Application No. 201180075087.4, 11 pages.
(Continued)

*Primary Examiner* — Luan K Bui
(74) *Attorney, Agent, or Firm* — Seed IP Law Group LLC

(57) ABSTRACT

Delivering bags, for example, for delivering items and products purchased bye-commerce in so-called "grocery" tote bags to the respective purchasing customers is described. In one embodiment, a system includes a box and a plurality of bag protectors, each made of material having sufficient rigidity to protect a bag contained therein. In one embodiment, the bag protector has a bottom panel configured to support a bottom of the bag, and two side panels that are configured to extend from two opposing edges of the boom panel away from the bottom panel to form a generally tapering profile so as to meet each other adjacent an opening portion of the bag. The box is configured to receive a plurality of bag protectors, each protectively containing a bag therein. For example, given the generally tapering profile of the bag protectors, they may be placed alternately facing opposite directions in the box.

15 Claims, 8 Drawing Sheets

(51) Int. Cl.

| | |
|---|---|
| ***B65D 5/00*** | (2006.01) |
| ***B65D 5/50*** | (2006.01) |
| ***A47F 9/04*** | (2006.01) |
| ***B65B 55/00*** | (2006.01) |

(58) Field of Classification Search
USPC ..... 206/499, 554; 229/117.27, 117.33, 229/117.34; 383/15, 104, 119
See application file for complete search history.

(56) References Cited

U.S. PATENT DOCUMENTS

| | | | | |
|---|---|---|---|---|
| 3,521,807 | A * | 7/1970 | Weisberg | B65D 77/064 206/216 |
| 4,638,912 | A * | 1/1987 | Graf | B65D 33/16 206/524.8 |
| 4,706,297 | A * | 11/1987 | Ausnit | B65D 33/2566 383/122 |
| 4,930,906 | A * | 6/1990 | Hemphill | B65D 31/02 229/117.27 |
| 5,083,700 | A * | 1/1992 | Mello | B65D 5/4204 206/806 |
| 5,437,406 | A * | 8/1995 | Gordon | B65D 5/18 229/104 |
| 6,102,568 | A * | 8/2000 | Davis | B65D 33/02 229/103.11 |
| 6,190,756 | B1 | 2/2001 | Yokoyama et al. | |
| 6,382,412 | B1 * | 5/2002 | Wood | B65D 5/422 206/232 |
| 7,344,022 | B2 * | 3/2008 | Madson | B65D 33/25 206/205 |
| 7,581,643 | B2 | 9/2009 | Wilskey et al. | |
| 8,235,213 | B2 | 8/2012 | Berry et al. | |
| 2005/0284906 | A1 | 12/2005 | Potts et al. | |
| 2009/0084699 | A1 | 4/2009 | Berry et al. | |
| 2009/0226118 | A1 | 9/2009 | Veder | |
| 2009/0288981 | A1 | 11/2009 | Fedor | |
| 2011/0270696 | A1 | 11/2011 | Vincent et al. | |
| 2011/0277762 | A1 | 11/2011 | Berry et al. | |

FOREIGN PATENT DOCUMENTS

| | | | |
|---|---|---|---|
| CN | 101815653 | A | 8/2010 |
| DE | 1 085 090 | B | 7/1960 |
| DE | 200 19 591 | U1 | 5/2001 |
| FR | 1 231 535 | A | 9/1960 |
| GB | 2 372 491 | A | 8/2002 |
| JP | 47-4128 | | 1/1971 |
| JP | 55-131989 | | 3/1979 |
| JP | 06-211235 | A | 8/1994 |
| JP | 2000-085789 | A | 3/2000 |
| JP | 2000-190953 | A | 7/2000 |
| JP | 2002-284234 | A | 10/2002 |
| JP | 2004-135916 | A | 5/2004 |
| JP | 2005-329955 | A | 12/2005 |
| JP | 2006-176172 | A | 7/2006 |
| JP | 2008-087805 | A | 4/2008 |
| JP | 2008-110786 | A | 5/2008 |

OTHER PUBLICATIONS

Extended European Search Report dated Jun. 23, 2015, for corresponding EP Application No. 11875416.7-1708 / 2776325, 5 pages.
International Search Report dated Apr. 2, 2012, for corresponding International Application No. PCT/US2011/059809, 1 page.
Japanese Office Action dated Jul. 7, 2015, for corresponding JP Application No. 2014-541014, 6 pages.
European Examination Report dated Feb. 11, 2016, for corresponding EP Application No. 11875416.7, 5 pages.

* cited by examiner

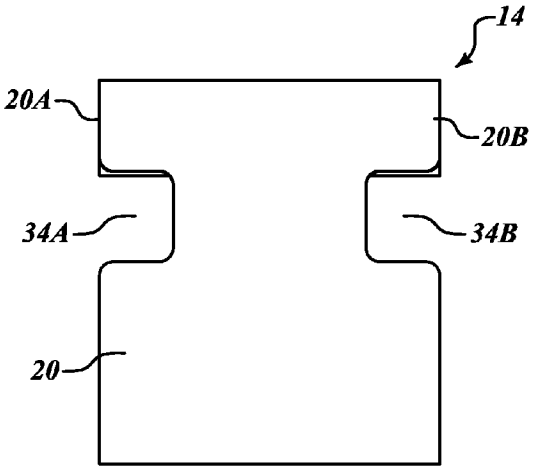
FIG.4A
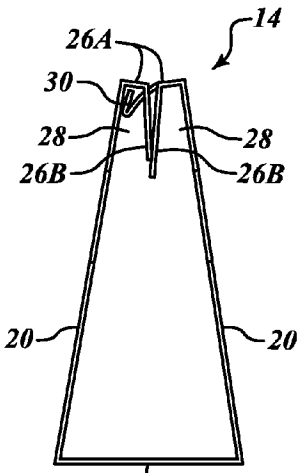
FIG.4B
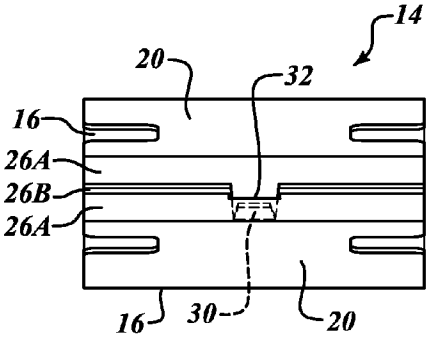
FIG.4C
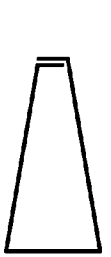
FIG.4D
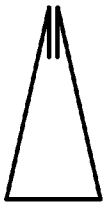
FIG.4E
FIG.4F
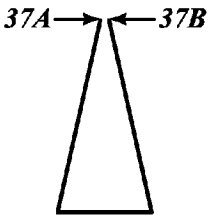
FIG.4G

SYSTEM AND METHOD FOR BAG DELIVERY

BACKGROUND

Electronic marketplaces, such as those accessible via the Internet, may include a catalog of items or products available for purchase. These items may be offered as the basis for commerce (e.g., sale or trade). In one example, customers may utilize a web browser to visit a merchant's website, select an item for purchase from the catalog, and engage in a checkout process to finalize an order for the item. The merchant may operate a fulfillment network including various facilities in order to process such orders. For instance, the merchant may include a facility that prepares shipments of purchased items. A shipment carrier may acquire such shipments from the merchant and deliver the shipments to the respective purchasing customers.

While purchased items or products are typically shipped in boxes, some items or products, such as groceries, may be suited to be shipped in bags instead, such as in paper bags, plastic bags, and so-called "grocery" tote bags offered by grocery stores. In particular, many environmentally-conscious customers prefer using the tote bags, which are reusable and made of recyclable material. However, typical tote bags are not sturdy enough to ensure that the items and products inside are protected from damage during shipment. Also, the shape of a tote bag, combined with the soft material typically used to form a tote bag, make it difficult for a shipment carrier to mass-handle a plurality of bags efficiently. For example, it is difficult to stack tote bags on top of one another, hence to efficiently use limited space within a shipping container (e.g., in a shipping truck) during delivery. Further, tote bags often require careful handling by a shipment carrier, especially when it includes fragile items or products within.

BRIEF DESCRIPTION OF THE DRAWINGS

FIGS. 4A-4C are a front view, a side view, and a top view, respectively, of the bag protector of FIG. 2. FIGS. 4D-4G are side views of other examples of generally tapering profiles of a bag protector.

While the system and method for shipping products or items in bags are described herein by way of example for several embodiments and illustrative drawings, those skilled in the art will recognize that the system and method for shipping products or items in bags are not limited to the embodiments or drawings described. It should be understood that the drawings and detailed description thereto are not intended to limit the system and method for shipping items or products in bags to the particular form disclosed, but on the contrary, the intention is to cover all modifications, equivalents and alternatives falling within the scope of the system and method for shipping items or products in bags as defined in the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION

Various embodiments of a system and method for delivering bags containing purchased items and products are described. The systems and methods may be used to prepare purchased items or products for shipment in bags made of flexible material, such as tote bags, paper bags and plastic bags. In some situations, items and products are purchased through an electronic commerce portal. Bag protectors according to various embodiments of the present invention allow protectively and efficiently store a plurality of bags containing purchased items and products in a box. Thus, a ship carrier can readily mass-handle (e.g., stack up, slide) those boxes, each containing a plurality of bags to deliver the bags to the respective purchasing customers while minimizing damage to the items and products contained in the bags.

Figure 1:
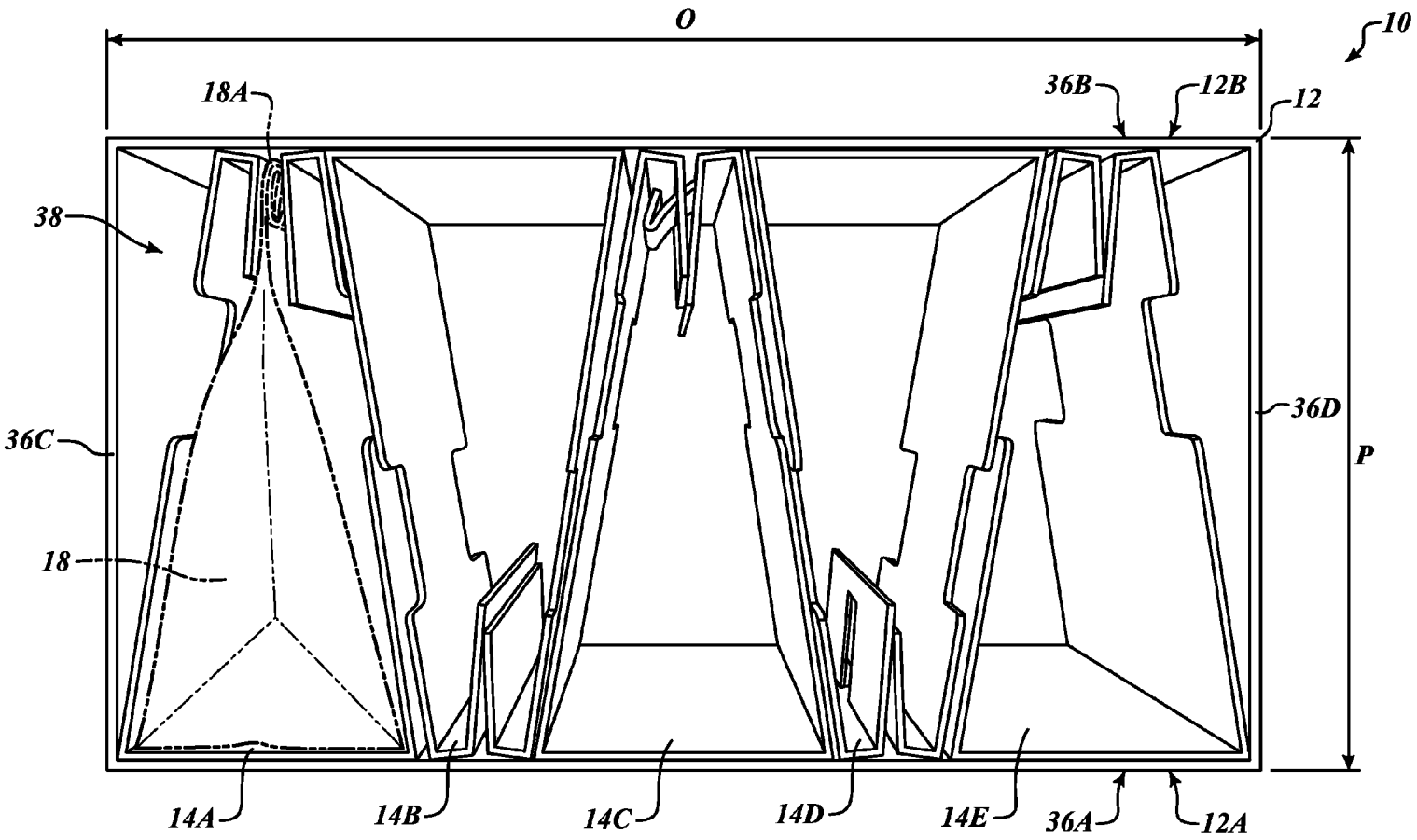
FIG. 1 is a top perspective view of a system for delivering bags according to one embodiment, including a box and a plurality of bag protectors contained in the box, with one of the bag protectors being illustrated to protectively contain a bag therein.
Figure 2:
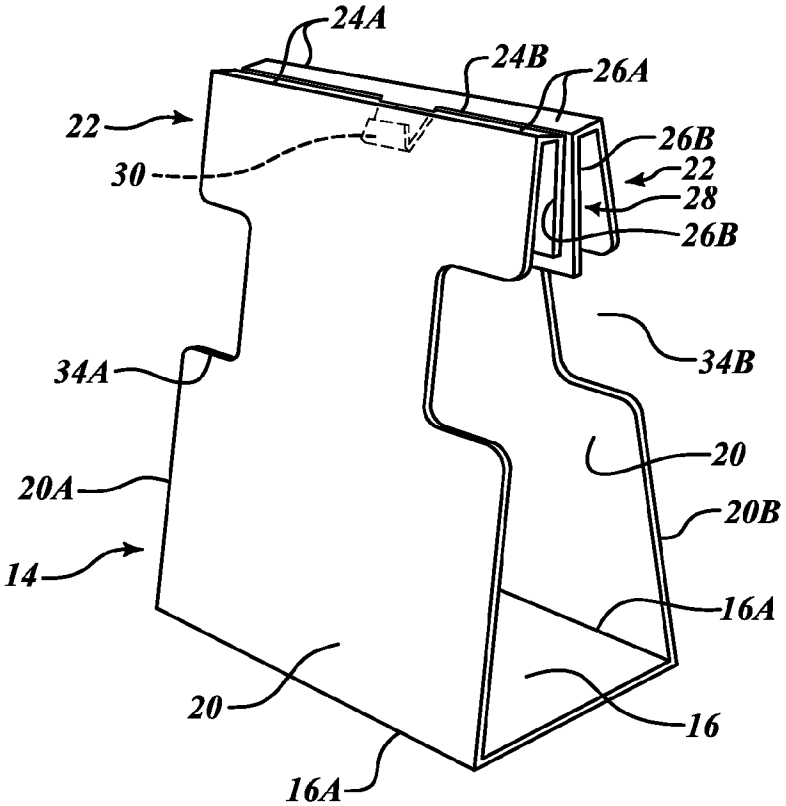
FIG. 2 is a perspective view of a bag protector according to a first embodiment.

FIG. 1 is a top perspective view of a system 10 for delivering bags according to one embodiment. The system 10 includes a box 12 and a plurality of bag protectors 14A-14E (five are shown in FIG. 1) contained in the box 12. One of the bag protectors, 14A, is illustrated to protectively contain a bag 18 made of flexible material therein. Referring additionally to FIG. 2, the bag protector 14 includes a bottom panel 16 sized and configured to support the bottom of a bag 18 containing various items or products. The bag protector 14 also includes two side panels 20 that are configured to extend from two opposing edges 16A of the bottom panel 16, away from the bottom panel 16, to form a generally tapering profile as seen from an open side of the bag protector 14. One example of the generally tapering profile is best shown in a side view of the bag protector 14 in FIG. 4B. FIGS. 4A and 4C are a front view and a top view, respectively, of the bag protector 14. In the illustrated embodiment, the two side panels 20 are configured to each form an acute angle with the bottom panel 16. As used herein, an acute angle is defined as an angle less than 90°.

Because of the generally tapering profile, the two side panels 20 meet each other adjacent an opening portion 18A of the bag 18, as shown in FIG. 1.

In accordance with various exemplary embodiments, the bag protector 14 is made of material having sufficient rigidity so as to protect a bag 18 made of flexible material within. Sample non-limiting examples of suitable material include cardboard (corrugated paper), plastic, corrugated plastic (corriboard), corrugated fiberboard, molded pulp (molded fiber), fabric that is reinforced (via protective coating, for example) to have sufficient rigidity, and metal.

Figure 3:
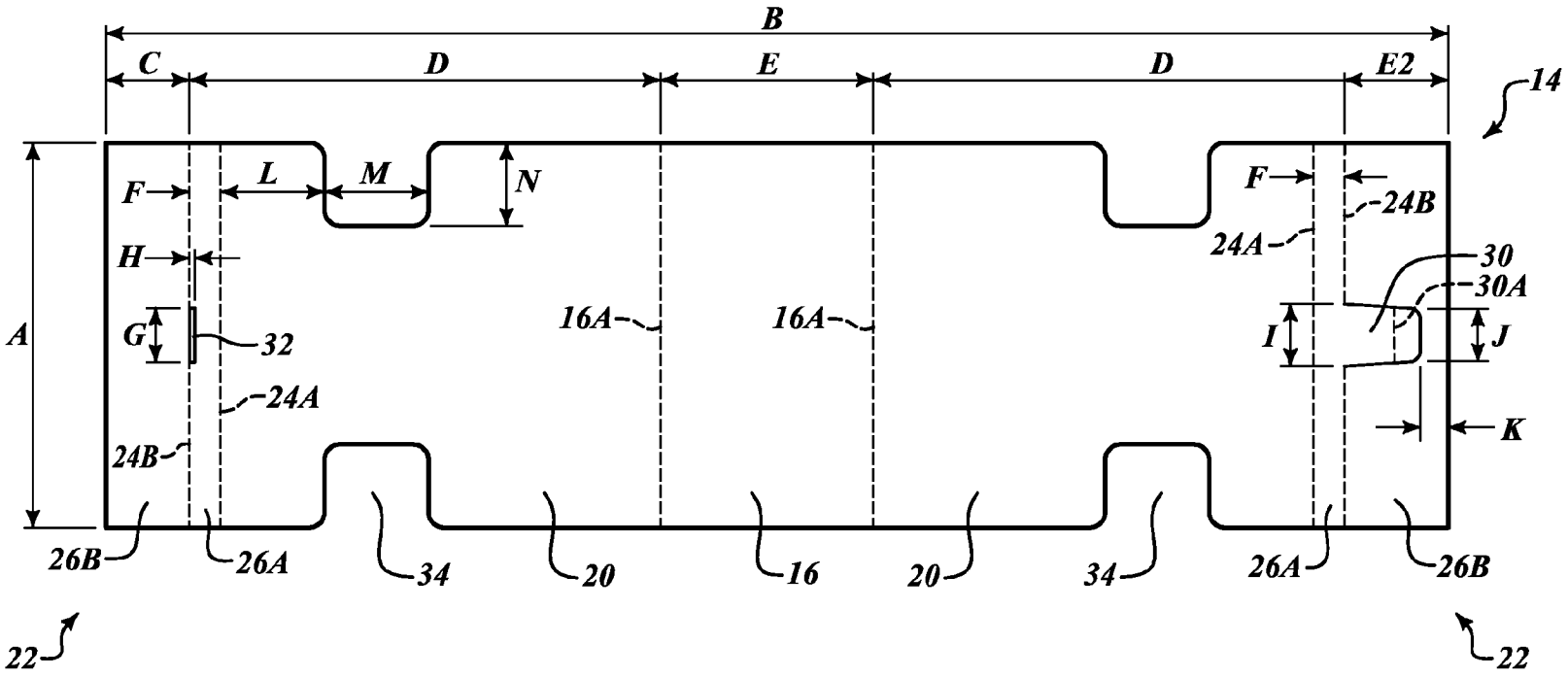
FIG. 3 is a design specification of the bag protector of FIG. 2.

FIG. 3 is a design specification of a sample bag protector 14 suitably formed of cardboard material. In FIG. 3, solid lines define the lines along which the cardboard is cut, and broken lines indicate the lines along which the cardboard is folded. For example, the cardboard is folded along two opposing edges 16A of a bottom panel 16 to define two side panels 20.

Still referring to FIG. 3, the two side panels 20 respectively include folded portions 22 where they meet at a reduced end of the generally tapering profile. The folded portion 22 in the illustrated example includes a first fold line 24A, which defines a first fold panel 26A that forms an angle with the rest of the side panel 20 when folded. (See FIG. 4B). The folded portion 22 in the illustrated example further includes a second fold line 24B, which defines a second fold panel 26B that forms an angle with the first fold panel 26A when folded. Thus, after the folding, a space 28 is defined by a portion of the second side panel 20 near a reduced end of the generally tapering profile, the first fold panel 26A, and the second fold panel 26B, as shown in FIG. 2. In this example, the folded portions 22 add elasticity in a direction generally perpendicular to the surfaces of the side panels 20, to snugly bind an opening portion 18A of a bag 18 received in the protector 14. The illustrated example further includes an insert 30 cut out from one of the folded portion 22, which is sized and configured to be received within a slit 32 defined in the other of the folded portion 22, to further ensure that the folding portions 22 of the two side panels 20 meet each other. In the illustrated embodiment, the insert 30 may further include a fold line 30A, along which the insert may be folded to form a locking mechanism when the insert 30 is placed into the slit 32, as best shown in FIGS. 2 and 4B. Of course, this is one example of having the folding portions 22 meet each other and various embodiments of the invention are not limited to including such fold line 30A.

In the illustrated embodiment, the bag protector 14 further includes two cut out portions 34A and 34B respectively provided adjacent two side edges 20A and 20B of the side panel 20. The cut out portions 34A and 34B may serve as handles to facilitate easy holding and other handling of the bag protector 14 containing a bag therein. Also, the cut out portions 34A and 34B may serve as windows for a handler to visually confirm that a bag is contained within the bag protector 14.

Referring back to FIG. 1, the box 12 is sized and configured to include a plurality of bag protectors 14 therein, each protectively containing a bag (though only one bag protector 14A is illustrated to contain a bag 18 in FIG. 1). In accordance with one embodiment, the box 12 and the bag protectors 14 are sized and configured such that some of the bag protectors (14A, 14C, and 14E in FIG. 1) are included in the box 12 with their respective bottom panels 16 facing one surface 12A of the box 12, while the rest of the bag protectors (14B and 14D in FIG. 1) are included in the box 12 with their respective bottom panels 16 facing another surface 12B of the box 12 opposite to the original surface 12A. In other words, the plurality of bag protectors 14 are placed alternately facing opposite directions in the box 12 to efficiently occupy the space within the box 12. In the illustrated example of FIG. 1, which is a top view of the system 10 according to one embodiment, the box 12 and the bag protectors 14 are sized and configured such that the bag protectors 14 are placed "sideways" in the box 12, with their respective bottom panels 16 facing two intended side wall surfaces 36A (12A) and 36B (12B) of the box 12. That is, two opposing open sides of the bag protector 14 are respectively facing an intended top surface 38 and an intended bottom surface of the box 12.

Those skilled in the art will appreciate that, while the box 12 of FIG. 1 includes the intended top surface 38 that is open for illustrative purposes, the box 12 may include a suitable lid to close the opening such that a plurality of boxes 12 can be stacked on top of another. Also, while the box 12 of FIG. 1 includes an opening through its intended top surface 38, an opening may be provided through one or more of its intended side wall surfaces 36A-36D. Still further, while the box 12 of FIG. 1 includes the intended top surface 38 that faces one of the two opposing open sides of the bag protector 14, the box 12 may include an intended top surface that faces the bottom panels 16 of some of the bag protectors 14. That is, assuming that FIG. 1 is a side perspective view of an embodiment of the system 10 of the present invention, some of the bag protectors (14B and 14D in FIG. 1) may be placed in the box 12 "upside down" so that their respective bottom panels 16 face the intended top surface of the box, while the rest of the bag protectors (14A, 14C and 14E in FIG. 1) may be placed in the box 12 "right side up" so that their respective bottom panels 16 face the intended bottom surface of the box 12.

Those skilled in the art will appreciate that the generally tapering profile is not limited to what has been illustrated in the figures above, and may include, by way of non-limiting illustrations only, profiles as shown in FIGS. 4D-4G, for example, which are schematic side views of other examples of bag protectors. In particular, the profile as shown in FIG. 4G may be advantageous when a bag protector is formed of resilient material, such as plastic, corrugated plastic and metal, to be formed into the shape as shown in FIG. 4G in its natural condition. Then, a user may force apart top portions 37A and 37B of the bag protector to create an opening to insert a bag therethrough. Due to the resiliency of the material of the bag protector, once the bag is placed inside and the user no longer applies force, the top portions 37A and 37B automatically return to their original positions to meet each other, as shown in FIG. 4G. This configuration may be advantageous in allowing easy placement and removal of a bag in and out of a bag protector.

Figure 5:
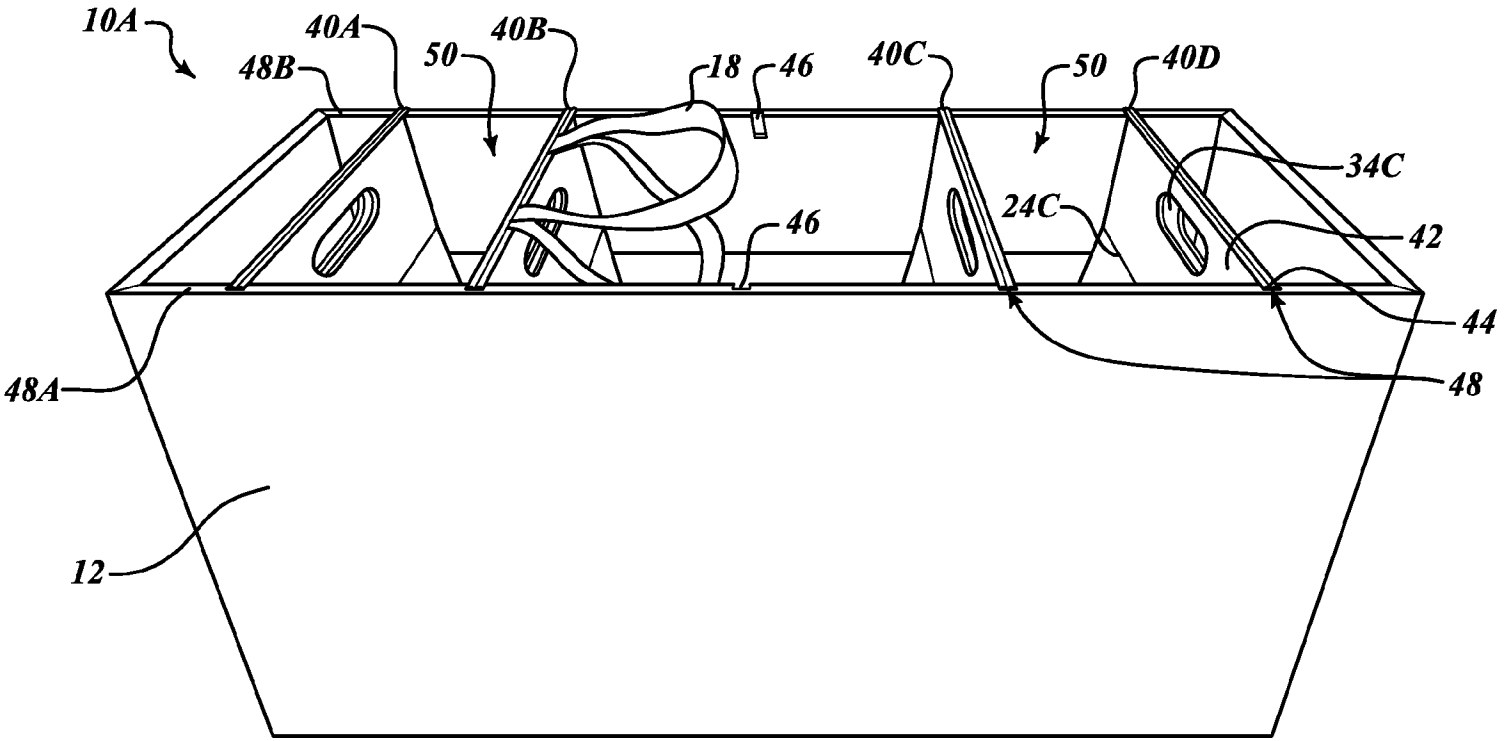
FIG. 5 is a perspective view of a system for delivering bags according to another embodiment, including a box and a plurality of bag protectors contained in the box, with one of the bag protectors being illustrated to protectively contain a bag therein.
Figure 6C:
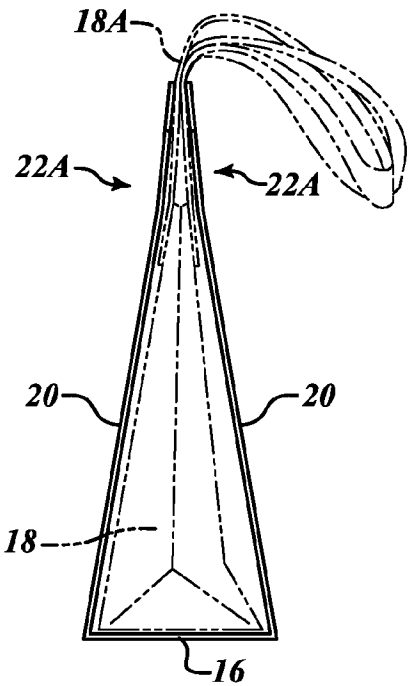
FIGS. 6A-6C are a front view, a side view, and another side view including a bag therein, respectively, of a bag protector according to a second embodiment as shown in FIG. 5.
Figure 6B:
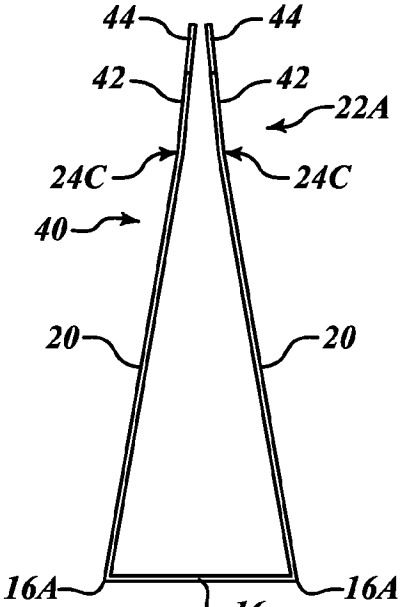
Figure 6A:
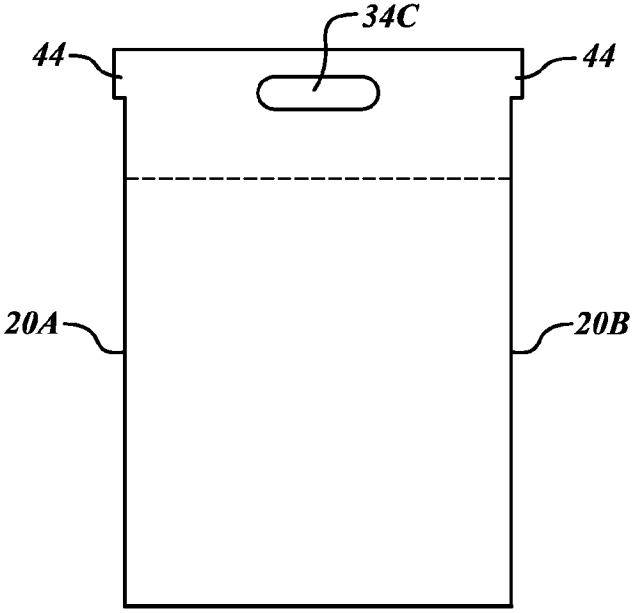

FIG. 5 is a perspective view of a further alternative embodiment of a system 10A for delivering bags according to the present invention, including a box 12 and a plurality of bag protectors 40A-40D. One of the bag protectors, 40B, is illustrated to contain a bag 18 therein. FIGS. 6A-6C are a front view, a side view, and another side view including a bag 18 therein, respectively, of the bag protector 40 according to the present embodiment. As with the embodiment shown in FIG. 2 above, the bag protector 40 includes a bottom panel 16 sized and configured to support a bottom of a bag 18 made of flexible material. The bag protector 40 further includes two side panels 20 that are configured to extend from two opposing edges 16A of the bottom panel 16, away from the bottom panel 16, to form a generally tapering profile to meet each other adjacent an opening 18A of the bag 18 as best shown in FIG. 6C. Also as before, in order to protect the contents of the flexible bag 18 therein, the bag protector 40 is suitably formed of material having sufficient rigidity, such as, for example, cardboard, plastic, reinforced fabric and metallic material.

Figure 7:
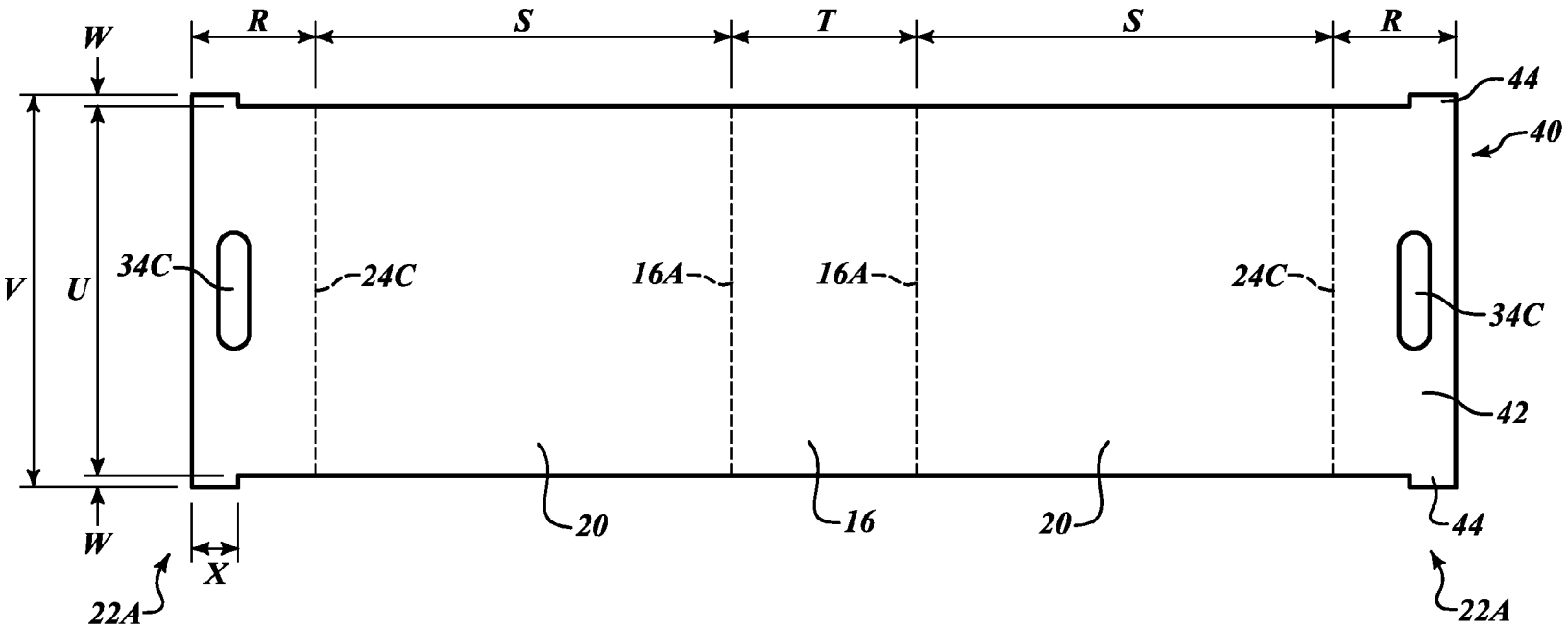
FIG. 7 is a design specification of a bag protector according to a second embodiment.

FIG. 7 is a design specification of the bag protector 40 shown in FIGS. 5 and 6A-6C, which may be suitably formed of cardboard material. In FIG. 6, solid lines define the lines along which the cardboard is cut, and broken lines indicate the lines along which the cardboard is folded. For example, the cardboard is folded along two opposing edges 16A of a bottom panel 16 to define two side panels 20.

Still referring to FIG. 7, the two side panels 20 respectively include folded portions 22A where they meet at a reduced end of the generally tapering profile. The folded portion 22A in the illustrated example includes a fold line 24C, which defines a flat panel portion 42 that forms an angle with the rest of the side panel 20 when folded, as best shown in FIG. 6B. The folded portions 22A of the side panels 20 are configured to snugly bind an opening portion 18A of a bag 18 received in the protector 40, as shown in FIG. 6C.

In the illustrated embodiment, the bag protector 40 further includes cut out portion 34C respectively defined in the folded portions 22A of the two side panels 20. As before, the cut out portions 34C may serve as handles to facilitate easy holding and other handling of the bag protector 40.

The illustrated embodiment of the folded portion 22A of the bag protector 40 further includes a pair of projections 44 extending laterally beyond both of the two side edges 20A and 20B of the side panel 20, as best shown in FIG. 6A. Referring additionally to FIG. 5, these projections 44 are configured to be received within corresponding recesses 46 defined along or adjacent the two opposing opening edges 48A and 48B of the box 12. In FIG. 5, five pairs of recesses 46 are defined along the opening edges 48A and 48B, to respectively receive five pairs of projections 44 to secure five bag protectors 40 in the box 12. (One pair of the recesses 46 in the middle are shown not to have received a pair of projections 44.)

The combination of a pair of projections 44 and a corresponding pair of recesses 46 is one example of a lock 48 to secure the bag protector 40 in the box 12. Those skilled in the art will appreciate that the lock 48 illustrated in FIG. 5 is merely one example of a mechanism for securing the bag protector 40 in the box 12, and that a bag protector 40 may be secured to the box 12 with various alternative locks. For example, while the recesses 46 in FIG. 5 are defined in internal side walls of the box 12, the recesses 46 may be defined in external side walls of the box 12 and may take various alternative configurations. Also, the projections 44 provided on the bag protector 40 may take various alternative configurations, such as the shape of a hook. Further alternatively, a lock is not limited to a combination of a projection provided on a bag protector and a corresponding recess provided in a box, and a lock may be formed, for example, with a projection provided on the box 12 and a recess formed in the bag protector 40. Further alternatively, any suitable means that can secure at least a portion of a bag protector within a box, such as magnets, springs, etc. may be used as a lock and are within the scope of the present invention.

Still referring to FIG. 5, when a plurality of the bag protectors 40 are secured to the box 12 with use of the locks 48, the bag protectors 40 have their respective bottom panels 16 facing one surface of the box 12 (the bottom surface of the box 12 in the illustrated example). The box 12 and the bag protectors 40 may be sized and configured such that, at this time, the bottom panels 16 do not come in contact with the bottom surface of the box 12; that is, the bag protectors 40 may be sized and configured to be suspended within the box 12. This may be advantageous in protecting the contents within the bag protectors 40 from shock or impact applied to the box 12, especially from the bottom side. Alternatively, the box 12 and the bag protectors 40 may be sized and configured such that the bottom panel 16 of each bag protector 40 comes in contact with the bottom surface of the box 12 when the bag protectors 40 are placed within the box 12.

Because each of the plurality of bag protectors 40 has a generally tapering profile, which is reduced from one end adjacent the bottom panel 16 to another end, they together define a plurality of spaces 50 in between. These spaces 50 too have a generally tapering profile, which is reduced from one end to another end adjacent the bottom panel 16 of each bag protector 40. In one embodiment, a further set of bags containing various items or products may be placed in these spaces 50, respectively, to efficiently use the space within the box 12. In one embodiment, these further set of bags may be placed directly in the spaces 50, without first being contained in bag protectors. In this case, the opening portion 18A of a bag to be directly placed in the space 50 may be folded to keep the contents therein.

Figure 8:
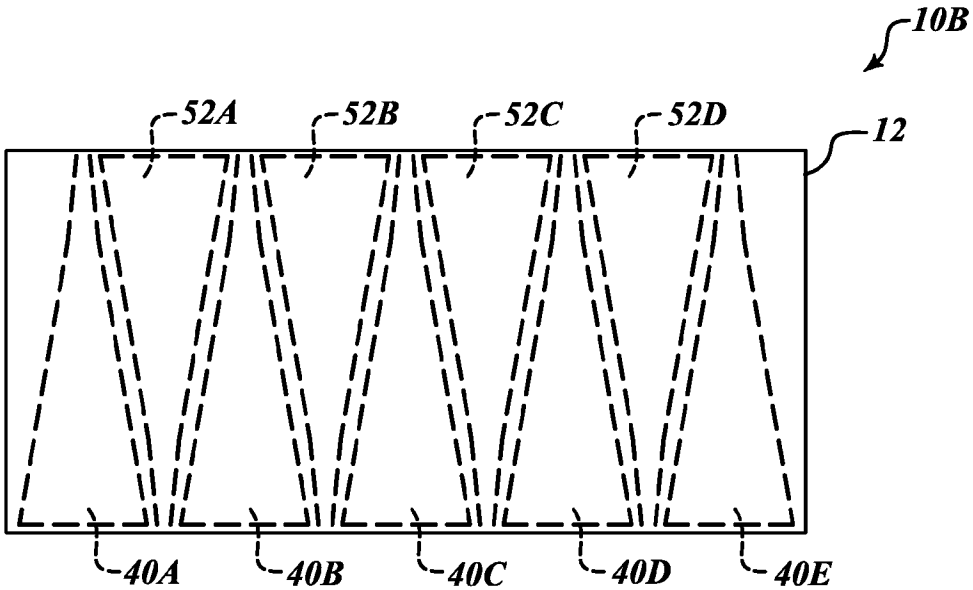
FIG. 8 is a cross-sectional side view of a system for delivering bags according to yet another embodiment, including a box and a plurality of bag protectors contained in the box, with the bag protectors alternately placed right side up and upside down.

In another embodiment, as shown in FIG. 8, these further set of bags are first contained in another set of bag protectors 52A-52D, and these bag protectors 52A-52A are alternately placed in between the original set of bag protectors 40A-40E. For the bag protectors 52A-52D to be received within the box 12, the bag protectors 52A-52D preferably do not include projections 44 (see FIG. 7) extending laterally beyond their two side edges. FIG. 8 is a cross-sectional side view of the system 10B according to this embodiment. Thus, in the illustrated example, the original set of bag protectors 52A-52A are placed in the box 12 "right side up" so that their respective bottom panels 16 face the intended bottom surface of the box 12, while the further set of bag protectors 52A-52D are placed in the box 12 "up side down." Of course, the orientation of the box 12 relative to the bag protectors is not so limited. Specifically, assuming that FIG. 8 is a top plan view of an embodiment of the system 10B of the present invention, some of the bag protectors (40A-40E) may be placed "sideways" so that their respective bottom panels 16 face one of two opposing intended side wall surfaces of the box, while the other bag protectors (52A-52D) are also placed "sideways" in the box 12 with their respective bottom panels 16 facing the opposing intended side wall surface of the box 12. Still further, while the box 12 is illustrated to have its intended top surface open in FIG. 5, a suitable lid may be provided to close the opening so as to facilitate stacking and other handling of the boxes 12. Still further, while an opening is illustrated to be provided through the intended top surface of the box in FIG. 5, an opening may instead be provided through one or more of the intended side wall surfaces of the box 12.

Figure 9:
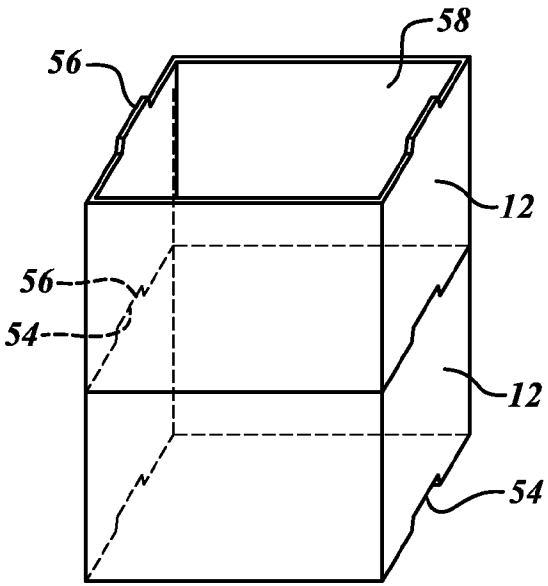
FIG. 9 is a perspective view of two boxes that are stacked together, each being suitable for containing a plurality of bag protectors according to various embodiments of the present invention.

FIG. 9 is a perspective view of two boxes 12 that are stacked together.

Each of these boxes 12 is suited to be sized and configured to contain a plurality of bag protectors according to various embodiments of the present invention. To facilitate easy stacking, each box 12 may include one or more indents 54 defined on its intended bottom surface 56, and one or more projections 56 defined on its intended top surface 58. These boxes 12 can be readily stacked on top of one another by engaging the projection(s) 56 of one box 12 with the corresponding indents of another box 12 above.

Purely as a non-limiting exemplary set of dimensions that may be used to configure a bag delivery system including a box 12 and bag protectors 14 of FIGS. 1 and 3, the following dimensions may be adopted: A=370 mm, B=1291 mm, C=80 mm, D=453 mm, E=205 mm, E2=100 mm, F=30 mm, G=52 mm, H=5 mm, I=60 mm, J=50 mm, K=27 mm, L=100 mm, M=100 mm and N=80 mm in FIG. 3; O=815 mm, P=437 mm, and the internal dimension of the box 12 perpendicular to both O and P=380 mm in FIG. 1. Further purely as a non-limiting exemplary set of dimensions that may be used to configure a bag protector 40 of a second embodiment as shown in FIG. 6, the following dimensions may be adopted: R=80 mm, S=270 mm, T=120 mm, U=240 mm, V=254 mm, W=7 mm and X=30 mm. Those skilled in the art will readily appreciate suitable dimensions of a box for containing a plurality of the bag protectors 40, including dimensions of any recesses 46 that may be provided along the two opposing opening edges of the box as well as their spacing.

In accordance with a further embodiment of the present invention, a method is provided for delivering bags using a combination of a box and a plurality of bag protectors, various embodiments of which have been described above. The method includes placing a plurality of bags 18 made of flexible material respectively in a plurality of bag containers 14, 40. The method further includes placing the plurality of those bag protectors respectively including the plurality of bags in the box 12. As described above, the plurality of bag protectors may be placed such that some of the plurality of bag protectors have their respective bottom panels 16 face one surface of the box while the rest of the plurality of bag protectors have their respective bottom panels 16 face another surface of the box opposite to the original surface of the box. (See FIG. 1, for example.)

In accordance with various exemplary embodiments, the plurality of bag protectors may be placed in the box such that their respective bottom panels 16 face two intended side wall surfaces of the box 12. (See FIG. 1, for example.) In accordance with further exemplary embodiments, the plurality of bag protectors may be placed in the box 12 such that their respective bottom panels 16 face an intended bottom surface of the box. (See FIG. 5, for example). In accordance with still further embodiments, the plurality of bag protectors may be placed in the box 12 such that their respective bottom panels 16 face one surface of the box 12, to thereby form a plurality of spaces 50 in between each having a generally tapering profile. The method then includes placing a further plurality of bags 18 in the plurality of spaces 50, respectively.

From the foregoing it will be appreciated that, although specific embodiments have been described herein for purposes of illustration, various modifications may be made without deviating from the spirit and scope of the invention. Accordingly, the invention is not limited except as by the appended claims and the elements recited therein.

What is claimed is:

1. A bag delivery system comprising:

a box; and a plurality of bag protectors, each of the bag protectors having a bottom panel configured to support a bottom of a bag made of flexible material, and two side panels that are configured to extend from two opposing edges of the bottom panel away from the bottom panel to form a generally tapering profile such that top portions of the two side panels meet each other at a reduced end of the generally tapering profile;

wherein the bottom panel and the two side panels are made of material having rigidity;

wherein the top portions of the two side panels include two folded portions that meet each other at the reduced end of the generally tapering profile, and the two folded portions include two first fold panels that are configured to extend inwardly toward each other at an angle with the rest of a corresponding one of the two side panels, and two second fold panels that are configured to extend downwardly toward the bottom panel, from where the two first fold panels meet, at an angle with a corresponding one of the two first fold panels, so as to form two spaces defined by two portions of the two side panels near the reduced end, the two first fold panels, and the two second fold panels, respectively; and wherein the box is configured to include the plurality of bag protectors.

2. The bag delivery system of claim 1, wherein the box and the bag protectors are configured such that some of the plurality of bag protectors are included in the box with their respective bottom panels facing one surface of the box, while the rest of the plurality of bag protectors are included in the box with their respective bottom panels facing another surface of the box opposite to said one surface of the box.

3. The bag delivery system of claim 2, wherein the box and the bag protectors are configured such that the plurality of bag protectors are included in the box with their respective bottom panels facing two intended side wall surfaces of the box.

4. The bag delivery system of claim 1, wherein the box and the bag protectors are configured such that the plurality of bag protectors are included in the box with their respective bottom panels facing one surface of the box, to thereby form a plurality of spaces in between, each having a generally tapering profile for receiving a plurality of bags therein.

5. The bag delivery system of claim 1, wherein the bag protector includes one or more cut out portions defined in the side panel.

6. The bag delivery system of claim 1, wherein the box includes plural pairs of locks defined along two opposing edges of the box, each pair of locks being configured to secure one of the plurality of bag protectors within the box.

7. The bag delivery system of claim 6, wherein the pair of locks comprises a pair of opposing recesses formed adjacent the two opposing edges of the box, and a pair of projections provided on the bag protector and configured to be received within the pair of recesses.

8. The bag delivery system of claim 1, further comprising a plurality of locks respectively configured to secure the plurality of bag protectors within the box.

9. The bag delivery system of claim 1, wherein the box includes one or more indents defined on its intended bottom surface and one or more mating projections defined on its intended top surface.

10. The bag delivery system of claim 1, wherein the bag protectors are made of material selected from a group consisting of cardboard, plastic, corrugated plastic, corrugated fiberboard, molded pulp, fabric, and metal.

11. A bag delivery system comprising:

a box; and a plurality of bag protectors, each of the bag protectors having a bottom panel configured to support a bottom of a bag made of flexible material, and two side panels that are configured to extend from two opposing edges of the bottom panel while forming an acute angle with the bottom panel so as to meet each other adjacent an opening portion of the bag;

wherein each of the bag protectors is made of resilient material such that the side panels meet each other in their original positions, and after being forced apart by external force and the external force then being removed, the side panels return to the original positions;

wherein the box is configured to include the plurality of bag protectors therein;

wherein the box includes plural pairs of locks defined along two opposing edges of the box, each pair of locks being configured to secure one of the plurality of bag protectors within the box; and wherein each pair of locks comprises a pair of opposing recesses formed adjacent the two opposing edges of the box and a corresponding pair of projections provided on each of the bag protectors and configured to be received within the pair of recesses.

12. The bag delivery system of claim 11, wherein the box and the bag protectors are configured such that the plurality of bag protectors are included in the box with their respective bottom panels facing one surface of the box, to thereby form a plurality of spaces in between, each having a generally tapering profile for receiving a plurality of bags therein.

13. The bag delivery system of claim 11, wherein the bag protector includes one or more cut out portions defined in the side panel.

14. The bag delivery system of claim 11, wherein the box includes one or more indents defined on its intended bottom surface and one or more mating projections defined on its intended top surface.

15. The bag delivery system of claim 11, wherein the bag protectors are made of material selected from a group consisting of cardboard, plastic, corrugated plastic, corrugated fiberboard, molded pulp, fabric, and metal.

* * * * *